United States Patent [19]

Scheckel

[11] Patent Number: 4,615,311

[45] Date of Patent: Oct. 7, 1986

[54] COMBINED MANUAL AND POWER STARTING DEVICE FOR GASOLINE ENGINES

[76] Inventor: William D. Scheckel, 19716 Millhaven St., Independence, Mo. 64056

[21] Appl. No.: 729,036

[22] Filed: Apr. 30, 1985

[51] Int. Cl.[4] ..... F02N 3/02; F02N 11/12

[52] U.S. Cl. ..... 123/179 P; 123/185 B; 74/6

[58] Field of Search ..... 123/179 P, 179 SE, 185 A, 123/185 B, 185 BA; 74/6, 625

[56] References Cited

U.S. PATENT DOCUMENTS

| | | | |
|---|---|---|---|
| 1,284,850 | 11/1918 | Aichele | 123/179 P |
| 2,804,957 | 9/1957 | Pechin, Jr. | 192/107 R |
| 2,939,448 | 6/1960 | Hansen | 123/179 P |
| 3,219,021 | 11/1965 | Mercer et al. | 123/179 P |
| 4,157,083 | 6/1979 | Smith et al. | 123/179 P |

*Primary Examiner*—Andrew M. Dolinar
*Attorney, Agent, or Firm*—John A. Hamilton

[57] ABSTRACT

A combined manual and power starting device for a gasoline engine which may be started by rotating the crankshaft thereof, the starting device consisting of a pair of rotary drive members operable respectively by manual and power devices, the manual device consisting of a pulley and a rope wrapped around the pulley to be pulled to turn the pulley in one direction to start the engine, so that the pulley cannot be turned by any device other than the rope without unwinding the rope therefrom, a power train connecting the power drive member to the crankshaft through a primary overrunning clutch, and a power train connecting the manual drive member to the crankshaft through the primary clutch, and also a secondary overrunning clutch, the secondary clutch being in series with the primary clutch but not in the power train from the power drive member to the crankshaft.

3 Claims, 4 Drawing Figures

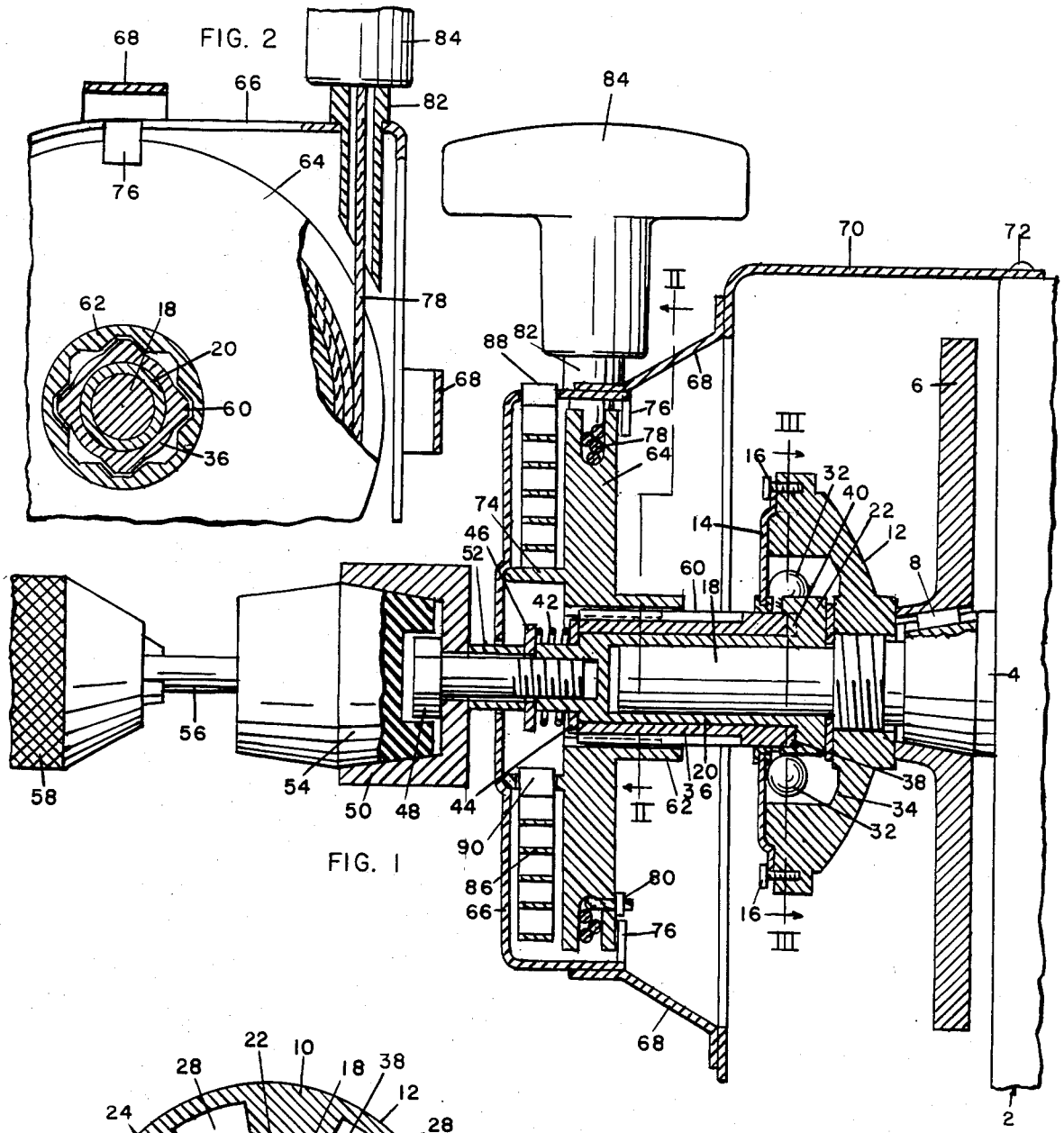
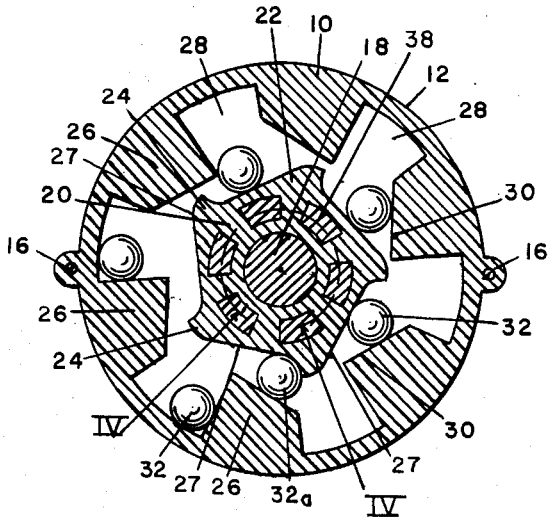
FIG. 3
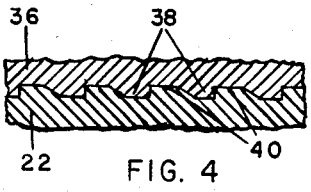
FIG. 4

COMBINED MANUAL AND POWER STARTING DEVICE FOR GASOLINE ENGINES

This invention relates to new and useful improvements in starting devices for gasoline engines which may be started by spinning the crankshafts thereof, such as are commonly used to drive power lawnmowers, tillers and other lawn and garden equipment. More particularly, it relates to engines in which the manual starting capability is provided by a pull-rope device.

In pull-rope starting devices, the starting impetus is provided by pulling on a rope wound around a pulley connected to the engine crankshaft, the connection being through a "one-way" or overrunning clutch, so that the pulley is effectively disconnected from the crankshaft after the engine starts and turns its crankshaft at a higher rate of speed than it can be turned by the pulley. This is conventional practice. However, engines are often very difficult to start with pull-rope starters, particularly by the elderly and infirm, or persons with heart conditions or the like, and it then becomes desirable to provide the engine with an alternatively usable power starter, such as the starter device driven by an ordinary electric drill, as shown in my prior copending application Ser. No. 475,307, filed Mar. 14, 1983. When adding any power driven starting device to an engine already equipped with a pull-rope starter, it must be connected into the power train ahead of the overrunning clutch, in order to take advantage of the operation thereof. However, this arrangement creates a problem, in that if the power starting elements are then used, the starting rope is unwound from the pulley, creating tangling of the rope and serious malfunctions. The overcoming of this problem is the overall object of the present invention. Generally, this object is accomplished by the provision of a secondary overrunning clutch. That is, the power starting elements are connected directly to the primary overrunning clutch, and the rope starting elements are connected to the driving elements of the primary clutch through the secondary clutch. Thus, when the power starting elements are put into use, the driving elements of the primary clutch turn more rapidly than the pulley, which is not turning at all, and the secondary clutch yields, and the pulley does not turn. The use of alternative starting capabilities, rather than relying solely on power starting, provides considerable economic advantages. It is obviously far less expensive to provide an engine with a simple attachment powered by an electric drill, than it is to provide each implement powered by a gasoline engine with its own electric starter motor and an electric battery to power the motor. Furthermore, once an engine has been started and thoroughly warmed, it is generally quite easy to restart it with the pull-rope starter, so that the power starter is then unnecessary. Also, the occasions requiring restarting of the engine often occur when the engine is located in remote areas far from a power source for driving an electric drill for power starting.

Other objects are simplicity and economy of construction, efficiency and dependability of operation, and adaptability to be produced simply and economically by minor variations of rope starter devices already in common use.

With these objects in view, as well as other objects which will appear in the course of the specification, reference will be had to the accompanying drawing, wherein:

FIG. 1 is a midsectional view of an engine starting device embodying the present invention, with parts left in elevation, FIG. 2 is a fragmentary sectional view taken on line II—II of FIG. 1, with parts broken away, FIG. 3 is a sectional view taken on line III—III of FIG. 1, and FIG. 4 is a fragmentary laid-out sectional view taken on curved line IV—IV of FIG. 3.

Like reference numerals apply to similar parts throughout the several views. The numeral 2 applies to a gasoline engine, shown fragmentarily, having a crankshaft 4 projecting horizontally therefrom, it being understood that the engine may be started by rotating said crankshaft, provided of course that the fuel and ignition conditions are properly set. A flywheel 6 is wedged on a tapered portion of said crankshaft, being secured against rotation relative thereto by a key 8, and being pressed firmly in place by the case 10 of an overrunning clutch indicated generally by the numeral 12, said case being screwed on a threaded portion of the crankshaft, thereby serving as a retaining nut for the flywheel. Said housing is hollow, being closed at its outer end by a cap 14 secured thereto by screws 16, and a reduced axial extension 18 of the crankshaft extends outwardly through an aperture provided therefor in said cap. Surrounding shaft extension 18 both slidably and rotatably is a cylindrical sleeve 20, which is formed integrally with a flat, generally circular head 22, the plane of which is normal to the shaft axis, disposed centrally within the hollow interior of clutch case 10. Said head, as best shown in FIG. 3, provides a number (five as shown) of teeth 24 equally angularly spaced at its periphery, each tooth having a front face directed in a clockwise direction, which is the direction the crankshaft must be turned to start the engine, and a straight back face 27 connected to the root of the adjoining tooth. The interior of case 10 provides a series of a different number (six as shown) of equally angularly spaced anvils 26 surrounding head 22, said anvils extending radially inwardly toward head 22, but not into the orbit of head teeth 24, so as not to interfere with rotation of the head. Between each successive pair of anvils is a pocket 28. Each anvil has an inner surface 30 which is parallel to the crankshaft axis, but inclined in a counter-clockwise direction. A number of steel balls 32 are disposed in the interior of case 10 around head 22, one ball for each anvil, and disposed one each between successive anvils. When head 22 is turned in a clockwise direction, one of balls 32 (ball 32*a* as shown) becomes wedged between one of head teeth 24 and surface 30 of one of anvils 26. Since it cannot pass therebetween, it forces case 10, and crankshaft 4, to turn to start the engine. When the engine starts, case 10 turns at full engine speed, faster than the rotation of head 22, and all of balls 32 are forced outwardly into pockets 28 by centrifugal force, so that head 22 does not interfere with rotation of the crankshaft. Since the number of head teeth 24 differs from the number of anvils, only one of balls 32 can be in driving position at any one time. If the clutch is arranged with its axis horizontal, as shown, each ball will tend to fall to head 22 by gravity, as that ball passes over the top of the shaft. If the clutch is arranged with its axis vertical, as is quite common with certain types of engines and implements, all of balls 32 will tend to roll inwardly toward head 22 by gravity, due to the inward slope of the inner wall of the case, as indicated at 34 in FIG. 1. This balltype overrunning clutch is already in common use, and I make no claim thereto per se. The sleeve 20 of clutch head 22 extends outwardly beyond the outer end of crankshaft extension 18, and is closed at its outer end.

Surrounding sleeve 20 both slidably and rotatably is a second cylindrical sleeve 36. Sleeve 20 extends outwardly beyond the outer end of sleeve 36. The inner end of sleeve 36 is formed to present radially arranged ratchet teeth 38 engaging with mating ratchet teeth 40 formed in the inner face of head 22 of sleeve 20, as shown in FIG. 4. It will be understood that when sleeve 36 is rotated in a clockwise direction, teeth 38 and 40 cooperate to turn head 22 in the direction said head must be turned to start the engine, as previously described. When sleeve 36 is rotated in the opposite direction, said teeth ratchet inoperatively over each other. Sleeve 36 is biased inwardly on sleeve 22, to urge said teeth into engagement, by a helical spring 42 surrounding the outwardly extended portion of sleeve 20, and compressed between a first washer 44 carried slidably on the extended portion of sleeve 20 but engaging the outer end of sleeve 36, and a second washer 46 fixed to the outer end of sleeve 20. A heavy screw 48 arranged axially of the starter engages in the interior of an outwardly opening, internally tapered driver cup 50, then extends through a spacer 52 and washer 46, and is threaded at its inner end into the drilled and tapped outer end of sleeve 20, whereby to hold the parts in assembly.

Driver cup 50 forms an element of the power starting system. It is ordinarily left in place permanently assembled with the starting mechanism as shown, and is adapted to receive into its tapered, outwardly opening end a similarly tapered drive member 54, formed of rubber or other material capable of providing good frictional engagement with the interior of the cup. The drive member is provided with an axial stem 56 capable of being clamped non-rotatively in the chuck 58 of an ordinary electric drill, not shown. When drive member 54 is pressed firmly into cup 50, and the drill energized, sleeve 20 will be turned in the clockwise direction required to start the engine.

The outer end portion of sleeve 36 is externally splined, as indicated at 60, to engage non-rotatively in the interior of the hollow hub 62 of a pulley 64, said hub being similarly splined. Said pulley is disposed in a plane normal to the crankshaft, and is carried in a dome 66 formed of sheet metal, and of inwardly opening cup form. Said dome is connected by struts 68 to an engine cowling 70, which is affixed to the housing of engine 2 by means characterized by screw 72. The outer hub 74 is supported rotatably in a depression provided therefor in dome 66. The pulley is retained in the dome by tabs 76 of said dome bent inwardly to overlap the inner face of the pulley adjacent its periphery. The pulley is peripherally grooved, and a rope 78 is wound in said groove, said rope being affixed at one end in the pulley, as at 80, wound around said pulley in a clockwise direction, and extending outwardly from said pulley, generally tangentially thereof, through a tubular fitting 82, and having a handle 84 affixed to the outer end thereof. When the handle is grasped and pulled upwardly, rope 78 causes the pulley, as well as the parts connected thereto and driven thereby, to rotate in a clockwise direction. Engagement of handle 84 with fitting 82 limits rotation of the pulley in a counter-clockwise direction, but the pulley is continuously biased in a counter-clockwise direction by a clock spring 86, said clock spring also being disposed within dome 66, outwardly of the pulley, being connected at its respectively opposite ends to dome 66 and the outer hub 74 of the pulley, as at 88 and 90. Thus when handle 84 is pulled outwardly to turn the pulley in a clockwise direction, and then released, spring 86 will turn the pulley in a counter-clockwise direction to rewind the rope and the pulley.

In operation, it will be seen that manual starting of engine 2 may be accomplished by pulling outwardly on handle 84. This causes rope 78 to turn pulley 64 in a clockwise direction, as viewed when facing the engine. The pulley turns outer sleeve 36, which operates through the secondary clutch characterized by ratchet teeth 38 and 40, then through the primary clutch 12 characterized by balls 32 to turn the crankshaft to start the engine. When the engine starts, and thus causes the case 10 of clutch 12 to turn at a higher speed than that induced by the pull rope, clutch balls 32 are moved outwardly by centrifugal force into pockets 28 of the case, so that clutch 12 becomes inoperative and there is no engine backlash to the starting mechanism. During this manual starting operation, inner sleeve 20 of course also turns, being connected to the outer sleeve by ratchet teeth 38 and 40. This also causes drive cup 50 of the power starting drive train to turn, since said cup is rigidly affixed to said inner sleeve. However, although said cup is disposed outwardly from dome 66, for easy accessibility in power startting, rotation thereof at this time is not dangerous, since clutch 12, disengaged by starting of the engine, also severs the drive connection to cup 50, so that said cup ceases rotation when the engine starts. This is a safety provision, made possible by the fact that clutch 12, when disengaged, severs any drive connection between the engine and both of the power input elements required respectively for manual and power starting, namely rope 78 and cup 50. If cup 50 were connected directly to the engine crankshaft, as is entirely possible, then rotation of cup 50, rotating at all times at full engine speed, and in an exposed position, would represent a serious hazard, since the operator's clothing might become fouled thereon, and cause damage or injury.

Power starting may be used by fitting drive cone 54 snugly into cup 50, clamping the stem 56 of said cone in chuck 58 of an electric drill, and energizing the motor of said drill, all as previously described. Rotation of the cup applies torque directly to inner sleeve 20 and thence to primary clutch 12 to start the engine, not utilizing the ratchet clutch since that clutch is disposed only in the drive train from pulley 64. Moreover, pulley 64 cannot be allowed to turn at this time, since rotation thereof would unwind rope 78 therefrom. Any such unwinding of the rope would create serious malfunction and possible damage to the equipment, particularly in any subsequent attempt to start the engine manually. Use of power starting does have a tendency to turn the pulley, since the ratchet teeth 38 and 40 are held loosely but yieldably in engagement by spring 42. However, rotation of the pulley in the direction urged by the loose clutch engagement is resisted by clock spring 86, and this resistance overcomes the resistance to clutch disengagement offered by spring 42, so that the clutch teeth ratchet freely, and the pulley does not turn to unwind the rope.

The essential features of this invention are believed to be the provision of a first one-way overrunning clutch in a common leg of the drive trains connecting the power and manual drive members (i.e. cup 50 and pulley 64) to the crankshaft, so that once the engine starts, neither drive member continues to turn, thus eliminating possibly dangerous situations, and, for use when only one drive member is in use and rotation of the other drive member could result in malfunctions, the provision of a second one-way overrunning clutch in a portion of the drive train of said other drive member not included in the drive train of the drive member in use.

While I have shown and described a specific embodiment of my invention, it will be readily apparent that many minor changes of structure and operation could be made without departing from the spirit of the invention.

What I claim as new and desire to protect by Letters Patent is:

1. A combined manual and power starting device for a gasoline engine of a type which may be started by rotating the crankshaft thereof, said starting device comprising:

a. a first sleeve mounted rotatably on an extended portion of said crankshaft;

b. a first overrunning clutch including a driving member formed by a portion of said first sleeve and a driven member fixed to said crankshaft, and operable to be automatically disengaged whenever said crankshaft rotates faster than said sleeve, and to be engaged to turn said crankshaft to start said engine when said sleeve is turned, said first sleeve being formed to present an outward extension coaxial with said crankshaft;

c. a second sleeve mounted rotatably and slidably on said first sleeve, said second sleeve having ratchet teeth at one end thereof operable by axial sliding thereof to engage matching ratchet teeth formed in the driving member of said first clutch to drive it in an engine-starting direction when rotated in one direction, and to ratchet freely over said driving member teeth when turned in the opposite direction, said second sleeve and the driving member of said first clutch thus forming respectively the driving and driven members of a second overrunning clutch, the clutches being connected in series, d. means biasing said second clutch yieldably to an engaged position, e. a rope pulley rotatably mounted in the engine housing coaxially with the crankshaft, and having axially slidable but non-rotatable connection with said second sleeve, f. a rope wound on said pulley and operable by outward manual tension thereon to turn said crankshaft in an engine-starting direction through both of said first and second clutches, said pulley having a hollow hub through which said crankshaft extension projects outwardly from the engine housing, and g. a drive member affixed to the outwardly extended end of said crankshaft extension and operable to be turned by power means.

2. A starting device as recited in claim 1 wherein the drive member affixed to the outer end of said crankshaft extension constitutes an outwardly opening tapered cup disposed coaxially with the crankshaft extension and adapted to receive a corresponding tapered member, connected to and driven by an ordinary electric drill, frictionally therein.

3. A starting device as recited in claim 1 wherein said means biasing said second clutch yieldably to an engaged position is relatively weak, and with the addition of relatively strong means biasing said rope pulley yieldably in a direction opposite to that in which it is turned by extension of said pulley rope, whereby said second clutch will be disengaged whenever the engine is started by rotation of the crankshaft extension.

* * * * *